US008294364B2

(12) United States Patent
Cho et al.

(10) Patent No.: US 8,294,364 B2
(45) Date of Patent: Oct. 23, 2012

(54) PLASMA DISPLAY PANEL AND METHOD OF MANUFACTURING THE SAME

(75) Inventors: Sung-Hee Cho, Suwon-si (KR); Sung-Soo Kim, Suwon-si (KR); Hyoung-Bin Park, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 185 days.

(21) Appl. No.: 12/688,670

(22) Filed: Jan. 15, 2010

(65) Prior Publication Data

US 2010/0207525 A1 Aug. 19, 2010

(30) Foreign Application Priority Data

Feb. 19, 2009 (KR) ..... 10-2009-0013996

(51) Int. Cl.
*H01J 17/49* (2012.01)

(52) U.S. Cl. ..... 313/586; 313/582; 313/292

(58) Field of Classification Search ..... 313/582, 313/292, 586

See application file for complete search history.

(56) References Cited

U.S. PATENT DOCUMENTS

| | | | | |
|---|---|---|---|---|
| 7,060,411 | B2 | 6/2006 | Mitsui et al. | |
| 7,384,900 | B2 | 6/2008 | Jo et al. | |
| 7,470,737 | B2 | 12/2008 | Mitsui et al. | |
| 2006/0197450 | A1* | 9/2006 | Kwon | 313/586 |
| 2006/0255730 | A1* | 11/2006 | Lim | 313/582 |
| 2007/0057634 | A1* | 3/2007 | Lim | 313/512 |
| 2007/0108907 | A1* | 5/2007 | Lee et al. | 313/582 |
| 2010/0207510 | A1* | 8/2010 | Kim et al. | 313/484 |

FOREIGN PATENT DOCUMENTS

| | | |
|---|---|---|
| JP | 10-269934 | 10/1998 |
| JP | 2002-063849 | 2/2002 |
| JP | 2005-174850 | 6/2005 |
| KR | 10-2003-0033957 | 5/2003 |
| KR | 10-2003-0059628 | 7/2003 |
| KR | 10-2005-0044132 | 5/2005 |
| KR | 10-2006-0083805 | 7/2006 |
| KR | 10-2007-0011729 | 1/2007 |

OTHER PUBLICATIONS

Office Action dated Aug. 30, 2010 for Korean Application No. 10-2009-0013996.

* cited by examiner

*Primary Examiner* — Karabi Guharay
(74) *Attorney, Agent, or Firm* — Knobbe Martens Olson & Bear, LLP

(57) ABSTRACT

A plasma display panel is disclosed. In one embodiment, the plasma display panel includes a first member, which is a base substrate for forming a phosphor layer, having at least one inclined surface. Also a method of manufacturing the plasma display panel is disclosed. In one embodiment, both the first member and a second member formed on the first member are manufactured using a photolithography method using different exposure masks. Accordingly, the plasma display panel may be manufactured having increased reliability and productivity and a method of manufacturing the plasma display panel is provided.

19 Claims, 9 Drawing Sheets

PLASMA DISPLAY PANEL AND METHOD OF MANUFACTURING THE SAME

CROSS-REFERENCE TO RELATED PATENT APPLICATION

This application claims the benefit of Korean Patent Application No. 10-2009-0013996, filed on Feb. 19, 2009, in the Korean Intellectual Property Office, the disclosure of which is incorporated herein in its entirety by reference.

BACKGROUND OF THE INVENTION

1. Field of the Invention

An aspect of the present invention relates to a plasma display panel and a method of manufacturing the same, and more particularly, to a plasma display panel with improved reliability and productivity and a method of manufacturing the same.

2. Description of the Related Technology

Plasma display panels are flat display apparatuses in which fluorescent substances coated on discharge cells are excited by applying a predetermined discharge pulse to discharge electrodes to generate visible light, and to realize a predetermined image using the visible light.

SUMMARY OF CERTAIN INVENTIVE ASPECTS

One aspect of the invention is a method of manufacturing a plasma display panel including a first member for increasing a phosphor coating surface to obtain uniform and increased luminance and methods of manufacturing the plasma display panel easily.

Another aspect of the present invention is a plasma display panel in which a phosphor layer is substantially coated on a first member uniformly.

Another aspect of the present invention is a plasma display panel with increased luminance and reliability.

Another aspect of the present invention is a plasma display panel with increased reliability and productivity by preventing cracks in the First dielectric layer while increasing luminance.

Another aspect of the present invention is a method of manufacturing the plasma display panel easily.

Another aspect of the present invention is a plasma display panel comprising: a first substrate and a second substrate facing the first substrate; a first member formed on the first substrate and comprising at least one inclined surface; a second member disposed between the first member and the second substrate and partitioning a discharge space between the first member and the second substrate into a plurality of discharge cells; a plurality of electrodes arranged across the plurality of the discharge cells; a phosphor layer disposed on the first member; and discharge gas filled in the discharge cells.

The first member may be used as a base layer for coating a phosphorous substance.

The first member may be formed using an exposure process and a development process, and a paste for forming the first member may include a photosensitive organic material. Examples of the photosensitive organic material include a photoinitiator, a cross-linking agent, and a binder. In a positive exposure, when the exposed photosensitive organic materials are exposed to light, they are reacted and thus hardened, and are included in the first member. In a negative exposure, the reaction product of the exposed photosensitive organic materials is removed using a developing solution, and thus the photosensitive organic materials that are not reacted because they are not exposed are included in the first member. Also, for a simpler manufacturing process, not only the first member but the second member may also include a photosensitive material. In addition, for a simpler manufacturing process, the second member may include the same photosensitive material as the first member.

The phosphor layer may be disposed over the inclined surface of the first member.

A surface area of the first member, which has the inclined surface, contacting the phosphor layer may be larger than a surface area of a first member that has no inclined surface contacting the phosphor layer.

A lateral surface of the first member may be the inclined surface.

A path of light emitted from a portion of the phosphor layer formed over the inclined surface of the first member may be shorter than a path of light emitted from a portion of the phosphor layer formed over a vertical surface of a first member.

The plasma display panel may further comprise a first dielectric layer formed between the first member and the first substrate, and a lower surface of the first member may contact the first dielectric layer, wherein a surface area of the first member contacting the first dielectric layer is greater than a surface area of the first member contacting the second member.

A lower surface area of the first member may be larger than an upper surface area of the first member. Accordingly, as the surface area of the first dielectric layer contacting the first member is increased, a contraction intensity of the first dielectric layer is reduced when firing the first dielectric layer and the second member at the same time, thereby preventing cracks which are caused due to a difference in heat expansion coefficients between the second member and the first dielectric layer.

The electrodes may comprise a discharge electrode pair comprising a scanning electrode and a sustaining electrode, to which a voltage is applied in an alternating manner to generate sustaining discharge, and an address electrode that is arranged to cross the scanning electrode, wherein a voltage is applied to the address electrode to generate address discharge using the scanning electrode.

The scanning electrode and the sustaining electrode may respectively include a bus electrode and a transparent electrode.

A discharge area in the discharge cells may be divided into a main discharge area comprising a phosphor layer that is formed on an upper surface and the inclined surface of the first member and an auxiliary discharge area comprising other areas of the phosphor layer disposed in the discharge cell, over which the first member is not formed, and the bus electrode may be arranged across the main discharge area.

The discharge electrode pair may be disposed on the second substrate, and the address electrode may be disposed on the first substrate. The plasma display panel may further comprise the second dielectric layer formed on the second substrate to cover the discharge electrode pair and a first dielectric layer formed on the first substrate to cover the address electrode.

The plasma display panel may further comprise a protection layer formed on the second dielectric layer.

The second member may comprise a plurality of horizontal second members and a plurality of vertical second members.

One of the horizontal second members may form a non-discharge cell with an adjacent horizontal member, and the one horizontal second member may form a discharge cell with another adjacent horizontal second member.

The first member may protrude both into the non-discharge cell and into the discharge cell.

The first member may comprise a first portion that protrudes into the non-discharge cell, and a second portion that protrudes into the discharge cell, wherein the second portion is broader than the first portion.

The one horizontal second member and the adjacent horizontal second member forming the non-discharge cell may be formed on the same first member.

Another aspect of the present invention is a method of manufacturing a plasma display panel, the method comprising: coating a first paste for forming a first member, on a substrate; drying the first paste; exposing the first paste using a first photomask; coating a second paste for forming a second member, on the first paste; drying the second paste; exposing the second paste using a second photomask; and developing the first paste and the second paste.

A ratio of a line width of the first photomask with respect to a width of the first member to be formed, may be smaller than a ratio of a line width of the second photomask with respect to a width of the second member to be formed.

The first photomask may have a line width of about 30 to about 70% of the width of the first member to be formed.

The second photomask may have a line width of about 80 to about 120% of the width of the second member to be formed.

A second distance between the second photomask and the second paste may be greater than a first distance between the first photomask and the first paste.

The method may further comprise: coating a third paste for forming a first dielectric layer, on the substrate; and drying the third paste, drying the third paste, wherein the first paste and the second paste are formed on the substrate, on which the third paste is disposed.

The method may further comprise, after developing the first paste and the second paste, forming a first dielectric layer and the first member having inclined surfaces and a second member, by firing the first paste, the second paste, and the third paste at the same time.

The method may further comprise: coating a fourth paste on the substrate on which the first dielectric layer and the second member are formed, by ejecting the fourth paste for forming a phosphor layer, from a nozzle while moving the nozzle; and drying the fourth paste. Another aspect of the invention is a plasma display panel comprising: a first substrate and a second substrate facing the first substrate; a first member formed over the first substrate and comprising at least one inclined surface; a second member disposed between the first member and the second substrate and partitioning a discharge space between the first member and the second substrate into a plurality of discharge cells; a plurality of electrodes arranged across the plurality of the discharge cells; a phosphor layer disposed on the first member and at least part of the second member; and discharge gas filled in the discharge cells.

In the above display panel, the inclined surface is at an angle of about 100° to about 170° with respect to the first substrate. In the above display panel, the first member is substantially parallel with at least one of the first and second substrates and wherein the second member is substantially perpendicular to the first member. In the above display panel, a lateral surface of the first member is inclined. In the above display panel, a path of light emitted from a portion of the phosphor layer formed on the inclined surface of the first member is shorter than a path of light emitted from a portion of the phosphor layer formed on the bottom surface of each discharge cell, and wherein the bottom surface is closer to the first substrate than the second substrate.

The above display panel further comprises a protection layer formed on the second dielectric layer, wherein the protection layer contacts the second member. In the above display panel, the second member comprises a plurality of row members and a plurality of column members, and wherein the row members and the column members cross each other. In the above display panel, one of the row members forms a non-discharge cell with an adjacent row member, and wherein the one row member forms a discharge cell with another adjacent row member. In the above display panel, the first member comprises a plurality of sub-first members which are substantially parallel with each other, and wherein the one row member and the adjacent row member forming the non-discharge cell are formed on the same sub-first member. In the above display panel, the first member comprises a plurality of sub-first members which are substantially parallel with each other, wherein the one row member and the adjacent row member forming the non-discharge cell are formed on two different sub-first members, respectively.

Another aspect of the invention is a method of manufacturing a plasma display panel, the method comprising: coating a first paste for forming a first member, on a substrate; drying the first paste; exposing part of the first paste using a first photomask so as to pattern the first paste; coating a second paste for forming a second member, on the first paste, wherein each of the first and second pastes comprises a photosensitive material, and wherein the second member is substantially perpendicular to the first member; drying the second paste; exposing part of the second paste using a second photomask, which is different from the first photomask, so as to pattern the second paste; and developing the first paste and the second paste.

The above method further comprises after developing the first paste and the second paste, forming a first dielectric layer and the first member having inclined surfaces and the second member, by substantially simultaneously firing the first paste, the second paste, and the third paste. In the above method, the first member comprises at least one inclined surface.

Still another aspect of the invention is a plasma display panel comprising: a first substrate and a second substrate facing the first substrate; a first member formed over the first substrate, wherein the first member comprises a plurality of sub-first members which are substantially parallel with each other, wherein each of the sub-first members comprises at least one inclined surface which is inclined with respect to at least one of the first and second substrates, and wherein the first member is substantially parallel with at least one of the first and second substrates; a second member contacting the first member, wherein the second member comprises a plurality of row members and a plurality of column members which cross each other so as to define a plurality of discharge cells between the first member and the second substrate, and wherein the second member is substantially perpendicular to the first member; and a phosphor layer formed on the first member and at least part of the second member.

DETAILED DESCRIPTION OF CERTAIN INVENTIVE EMBODIMENTS

Plasma display panels may include a first member in discharge cells coated with a phosphor layer in order to increase luminance.

Figure 1:
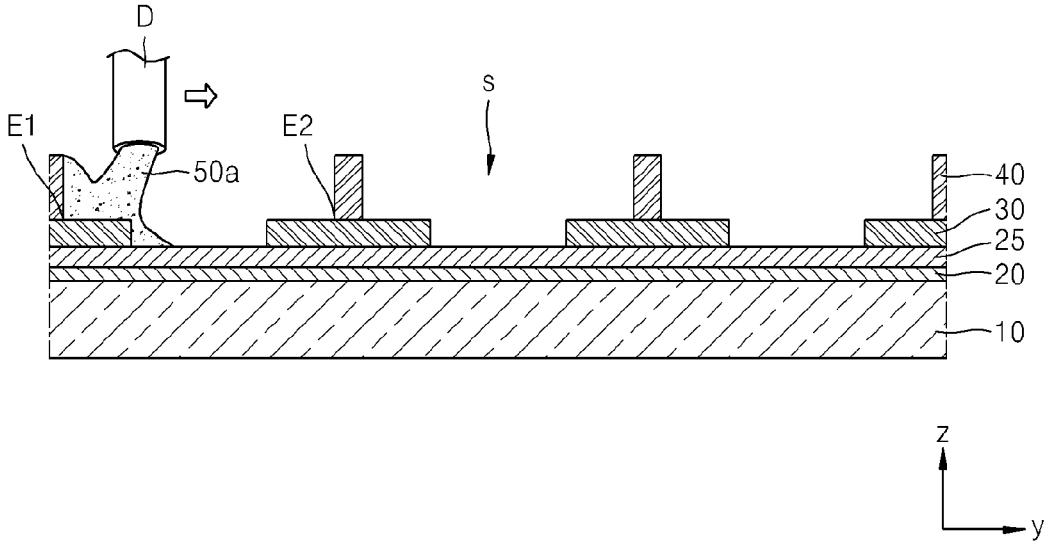
FIG. 1 is a cross-sectional view of a phosphor layer according to a method of manufacturing a plasma display panel.

FIG. 1 is a cross-sectional view of a phosphor layer according to a method of manufacturing a plasma display panel. Referring to FIG. 1, the plasma display panel includes a lower panel including a first substrate 10, an address electrode 20, the first dielectric layer 25, a first member 30 formed on the first dielectric layer 25, and a second member 40 formed on the first member 30. The first member 30 and the first dielectric layer 25 function as a base substrate for disposing a phosphor layer 50.

A phosphor layer paste 50*a* is spread on the first substrate 10, on which the first member 30 and the second member 40 are formed. The phosphor layer paste 50*a* is ejected from a dispenser nozzle D by moving the dispenser nozzle D in a predetermined direction (Y-direction). The phosphor layer paste 50*a* is coated on the first member 30 and the first dielectric layer 25.

Here, when coating the phosphor layer paste 50*a* by ejecting the phosphor layer paste 50*a* from the dispenser nozzle D by moving the dispenser nozzle D at a predetermined speed, edge regions E1 and E2 of the first member 30 or the second member 40 may not be coated at all. Also, the edge regions E1 and E2 may be coated unevenly compared to remaining regions of the first member 30 or the second member 40, or may be coated asymmetrically. For example, it is difficult to coat the edge region E2, which is facing against the direction the dispenser nozzle D is moved, than the edge region E1, which is facing along the direction the dispenser nozzle D is moved.

Figure 2:
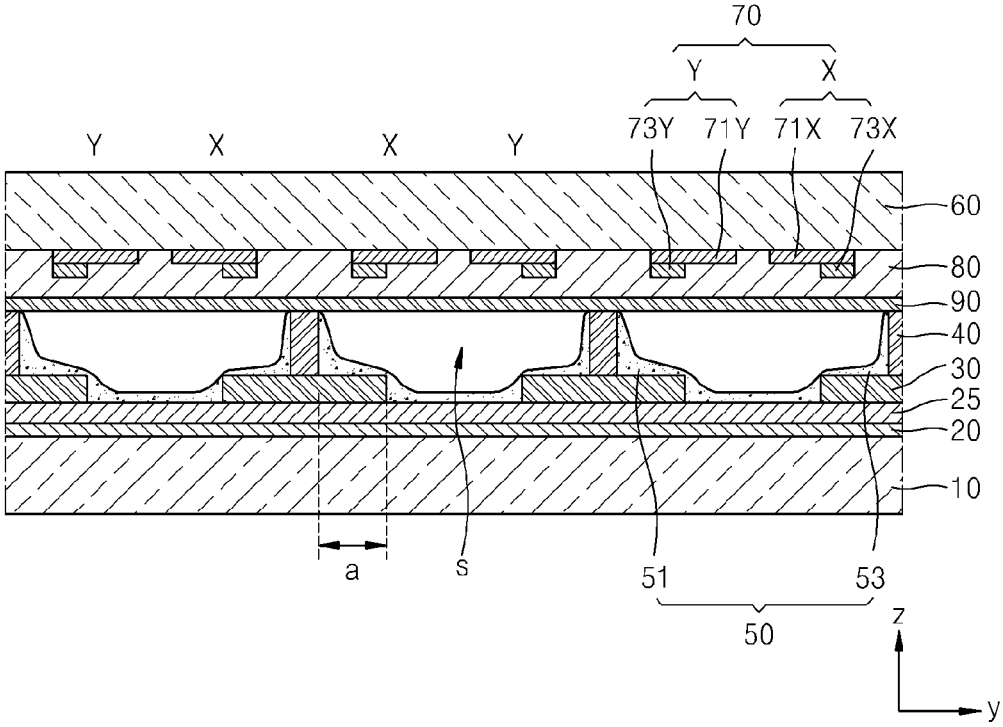
FIG. 2 is a cross-sectional view of a plasma display panel.

After completing the lower panel by coating, drying, and firing the phosphor layer paste 50*a*, an upper panel including a second substrate 60, a discharge electrode pair 70, a second dielectric layer 80, and a protection layer 90 is adhered to the lower panel, and then discharge gas is ejected between the two panels, thereby completing manufacturing of the plasma display panel. The discharge electrode pair 70 includes sustaining electrodes X and scanning electrodes Y. FIG. 2 is a cross-sectional view illustrating the above-described above plasma display panel.

Referring to FIG. 2, a phosphor layer 53 disposed on the first member 30 at the back of a discharge cell S may be coated less than a phosphor layer 51 that is disposed on the first member 30 at the front thereof. Light emitted from a phosphor layer that is disposed on an upper surface of the first member 30 has a shorter light emission path compared to a phosphor layer disposed on the first dielectric layer 25, and this may negatively affect luminance significantly. Accordingly, if the phosphor layer 51 disposed on an upper surface of the first member 30 at the front and the phosphor layer 53 disposed on the upper surface of the first member 30 at the back in the discharge cell S are coated differently, luminance may not be uniform.

Figure 3:
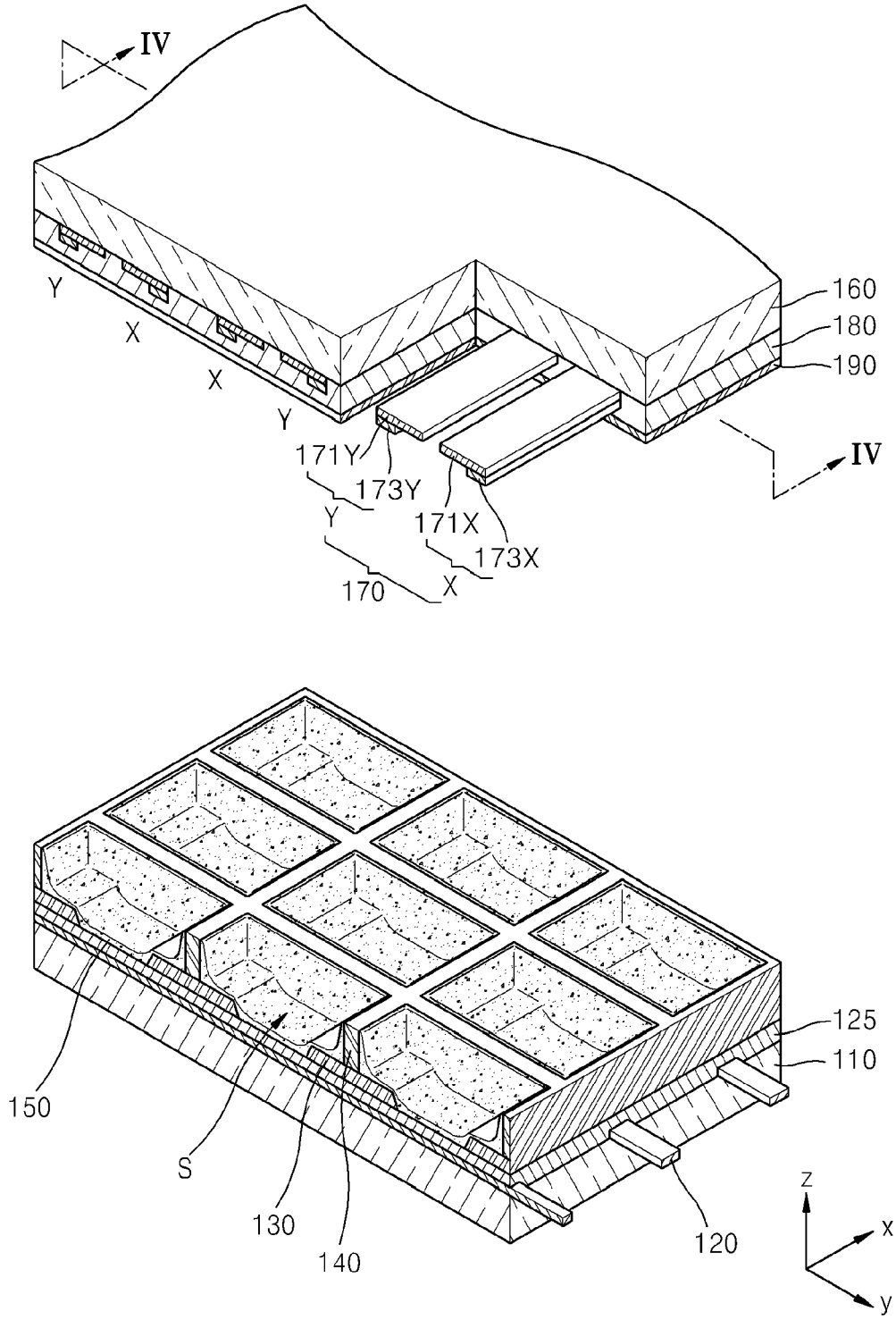
FIG. 3 is a partial perspective view of a plasma display panel according to an embodiment of the present invention.
Figure 4:
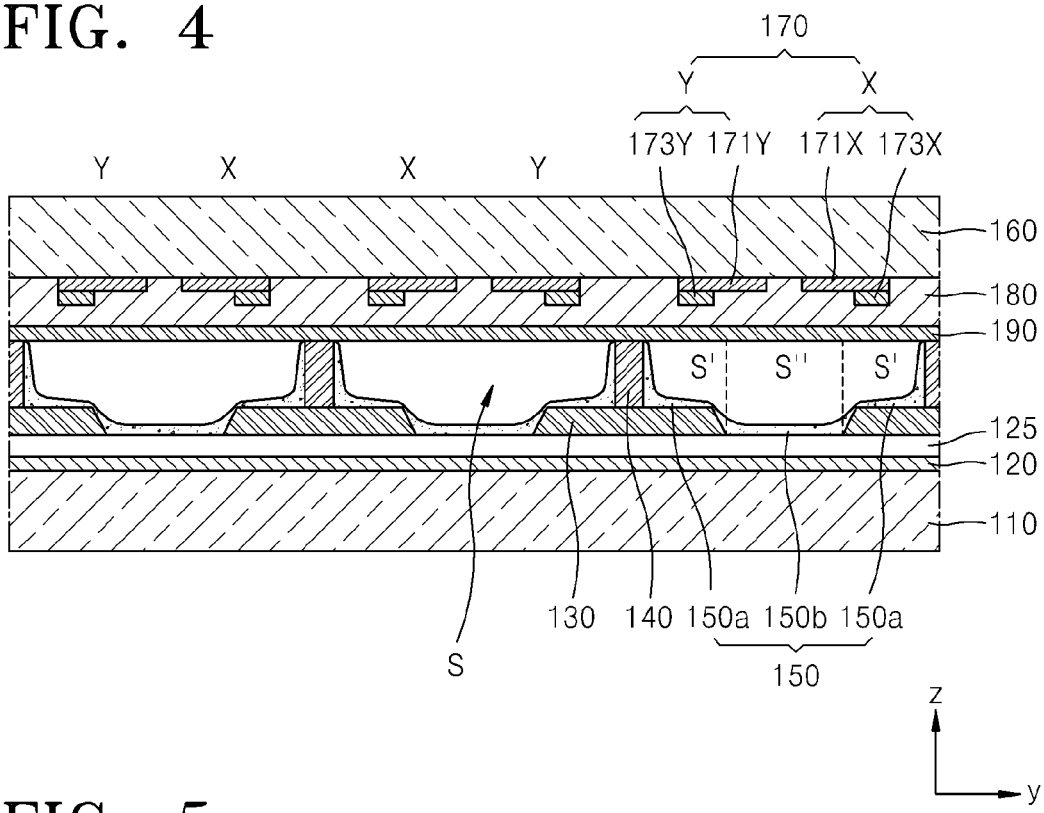
FIG. 4 is a cross-sectional view of the plasma display panel of FIG. 3 cut along a IV-IV line.
Figure 5:
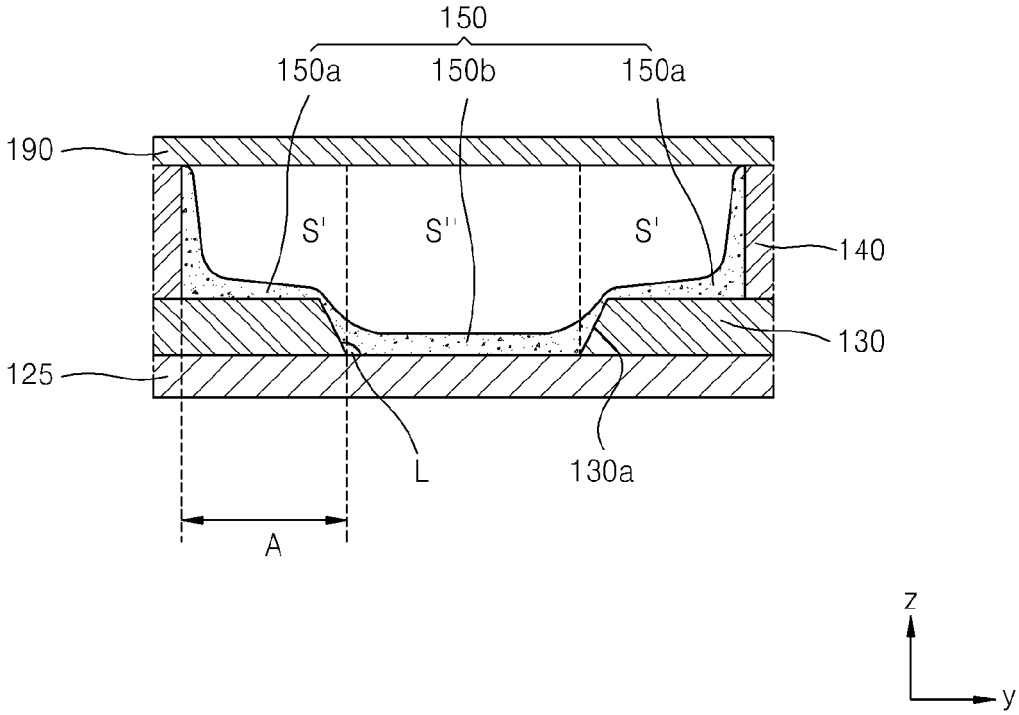
FIG. 5 is a cross-sectional view of a discharge cell of the plasma display panel of FIG. 4.

A plasma display panel according to an embodiment of the present invention will be described with reference to FIGS. 3 through 5. FIG. 3 is a partial perspective view of a plasma display panel according to an embodiment of the present invention. FIG. 4 is a cross-sectional view of the plasma display panel of FIG. 3. FIG. 5 is a cross-sectional view of a discharge cell of the plasma display panel of FIG. 4.

First, referring to FIG. 3, a plurality of address electrodes 120 are arranged substantially parallel to one another in a Y direction on a first substrate 110. Then the first dielectric layer 125 is disposed on the first substrate 110 to cover the address electrodes 120. A first member 130 is formed on the first dielectric layer 125 and a second member 140 is formed on the first member 130. In one embodiment, the first member is substantially parallel with at least one of the first and second substrates (110, 160). In one embodiment, the first member 130 and the second member 140 are substantially perpendicular to each other. In one embodiment, lateral surfaces of the first member 130 are inclined at a predetermined angle. For example, the inclined surfaces may be at an angle of about 100° to about 170° with respect to the first substrate 110. The second member 140 is formed on a portion of an upper surface of the first member 130. In one embodiment, a phosphor layer 150 is formed on exposed portions of the upper surface of the first member 130 where the second member 140 is not formed thereon and on the lateral surfaces of the first member 130. Also, the phosphor layer 150 may be formed on at least part of lateral surfaces of the second member 140 and on exposed portions of the first dielectric layer 125 where the first member 130 is not formed thereon. The phosphor layer 150 may be divided and classified into a green phosphor layer, a red phosphor layer, and a blue phosphor layer, according to the color of light emitted by the phosphor layers. Meanwhile, a plurality of sustaining discharge electrode pairs 170 are arranged in an X direction, which crosses the Y direction, on a second substrate 160, which displays an image. A second dielectric layer 180 is formed on the second substrate 160 to cover the sustaining discharge electrode pairs 170, and a protection layer 190 is formed on the second dielectric layer 180. The sustaining discharge electrode pairs 170 include scanning electrodes Y and sustaining electrodes X, respectively, and the scanning electrodes Y and the sustaining electrodes X each include bus electrodes and transparent electrodes. In detail, the scanning electrode Y includes a scanning transparent electrode 171Y and a scanning bus electrode 173Y, and the sustaining electrode X includes a sustaining transparent electrode 171X and a sustaining bus electrode 173X.

A discharge cell S is formed at a region where the sustaining discharge electrode pairs 170 and the address electrodes 120 cross and by the laterals sides of the second member 140. According to the current embodiment, matrix-type discharge cells S are illustrated; however, an aspect of the present invention is not limited thereto and discharge cells having various shapes such as a stripe shape, a disk shape, and so forth may be formed.

Discharge gas is inserted into the discharge cell S. The discharge gas may be a multi-element gas, in which xenon (Xe), krypton (Kr), helium (He), neon (Ne), and so forth, are mixed at a fixed volume ratio and which is capable of providing ultraviolet rays by discharge excitation.

The plasma display panel will be described in more detail with respect to FIGS. 4 and 5.

The sustaining discharge electrode pairs 170 are arranged on the second substrate 160. The sustaining discharge electrode pairs 170 include the scanning electrodes Y and the sustaining electrodes X, and a voltage is applied in an alternating manner between the scanning electrodes Y and the sustaining electrodes X to generate sustaining discharge. The sustaining discharge is generated after generating address discharge, in which a discharge cell to be displayed is selected. The address discharge may be generated by applying predetermined voltages, to the scanning electrodes Y and the address electrodes 120, respectively. The scanning electrode Y includes the scanning transparent electrode 171Y and the scanning bus electrode 173Y, and the sustaining electrode X includes the sustaining transparent electrode 171X and the sustaining bus electrode 173X. The scanning bus electrode 173Y may be arranged on the scanning transparent electrode 171Y and the sustaining bus electrode 173X may be arranged on the sustaining transparent electrode 171X.

In one embodiment, the discharge cell S of the plasma display panel may be divided and classified into a main discharge area S' and an auxiliary discharge area S". The main discharge area S' includes an area that emits light in a first area 150*a* of the phosphor layer 150 disposed on the upper and lateral surfaces of the first member 130. The auxiliary discharge area S" includes an area that emits light in a second area 150*b* of the phosphor layer 150 disposed on a lower surface of the discharge cell S or on the first dielectric layer 125. In one embodiment, the scanning bus electrode 173Y and the sustaining bus electrode 173X may be arranged to cross the main discharge area S'.

In one embodiment, the second member 140 is disposed on a portion of the upper surface of the first member 130, and the phosphor layer 150 is formed on remaining portions of the upper surface of the first member 130. The phosphor layer 150 may be also formed on the lateral surfaces of the first member 130. The first area 150*a* of the phosphor layer 150 disposed on the upper and lateral surfaces of the first member 130 has a shorter light path than the second area 150*b* of the phosphor layer 150 disposed on the lower surface of the discharge cell S, thereby increasing of the luminance. Accordingly, luminance may be further increased by disposing a bus electrode on the first area 150*a* of the phosphor layer 150 disposed on the upper and lateral surfaces of the first member 130.

Also, since the lateral surface of the first member 130 may be inclined, the path of light emitted from the first area 150*a* of the phosphor layer 150 formed on a portion of the first member 130 is relatively shorter than those of the second area 150*b*. That is, the portion having a relatively short path of light emitted from the phosphor layer 150 is relatively large, and thus the luminance can be increased. Accordingly, in order to increase a coating surface area of a fluorescent substance, the lateral surfaces of the first member 130 are inclined to increase the surface area of the first member 130. Referring to FIG. 2, the coating area of the phosphor layer 50 of the plasma display panel of FIG. 2 is the upper surface area of the first member 30 having a width "a." However, the coating area of the phosphor layer 150 of the plasma display panel may correspond to the upper and lateral surface areas of the first member 130 having a width A. Accordingly, compared to the plasma display panel illustrated in FIG. 2, the lateral surfaces of the first member 130 are further included in the coating area of the phosphor layer 150, and the surface area of the phosphor layer 150 may be increased.

Since the lateral surfaces of the first member 30 of the plasma display panel illustrated in FIG. 2 are vertical, compared to the phosphor layers 51 and 53 formed on the lateral surfaces of the first member 30, a discharge path of the first area 150*a* of the phosphor layer 150 formed on inclined surfaces 130*a* is shorter, and thus luminance may be further increased.

Figure 6:
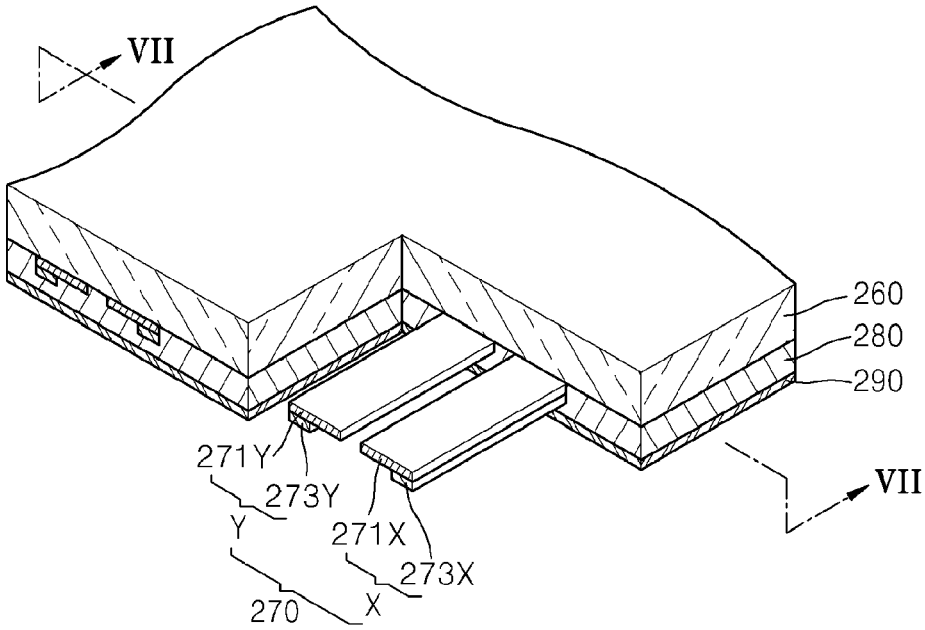
FIG. 6 is a perspective view of a plasma display panel according to another embodiment of the present invention.
Figure 6:
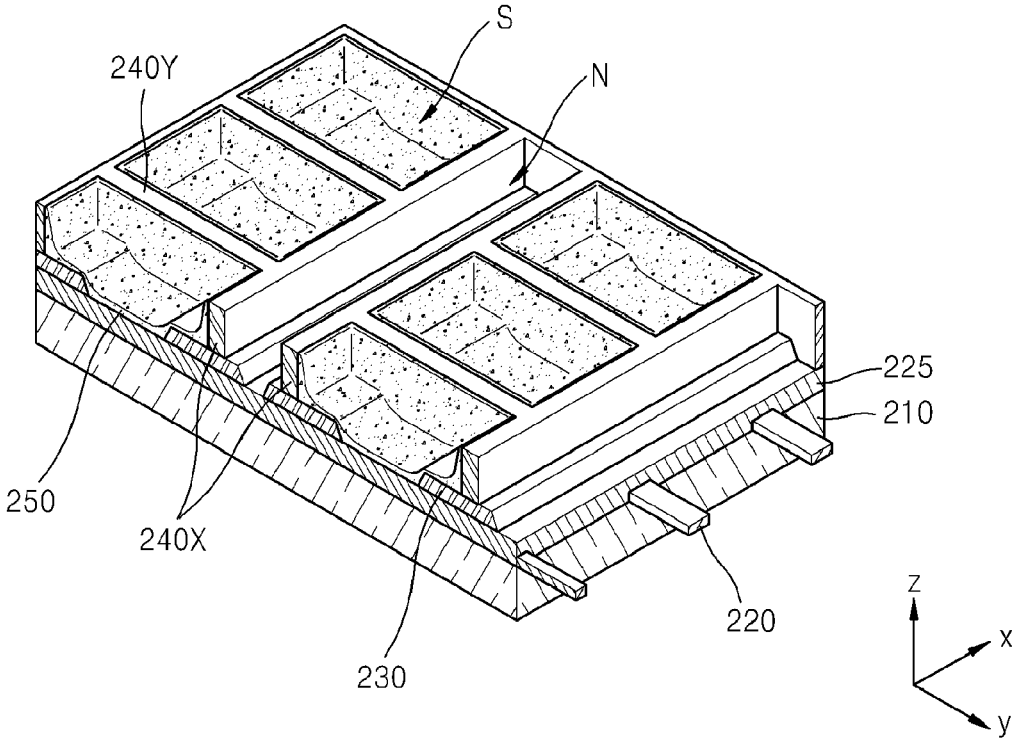
Figure 7:
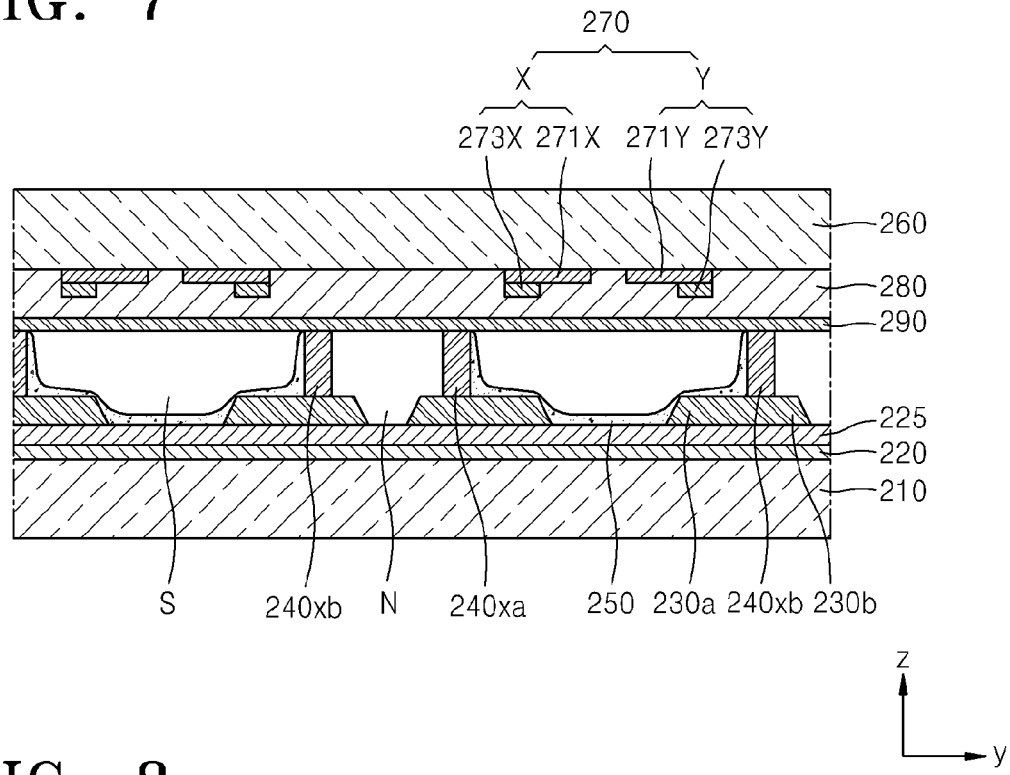
FIG. 7 is a cross-sectional view of the plasma display panel of FIG. 6 cut along a VI-VI line.
Figure 8:
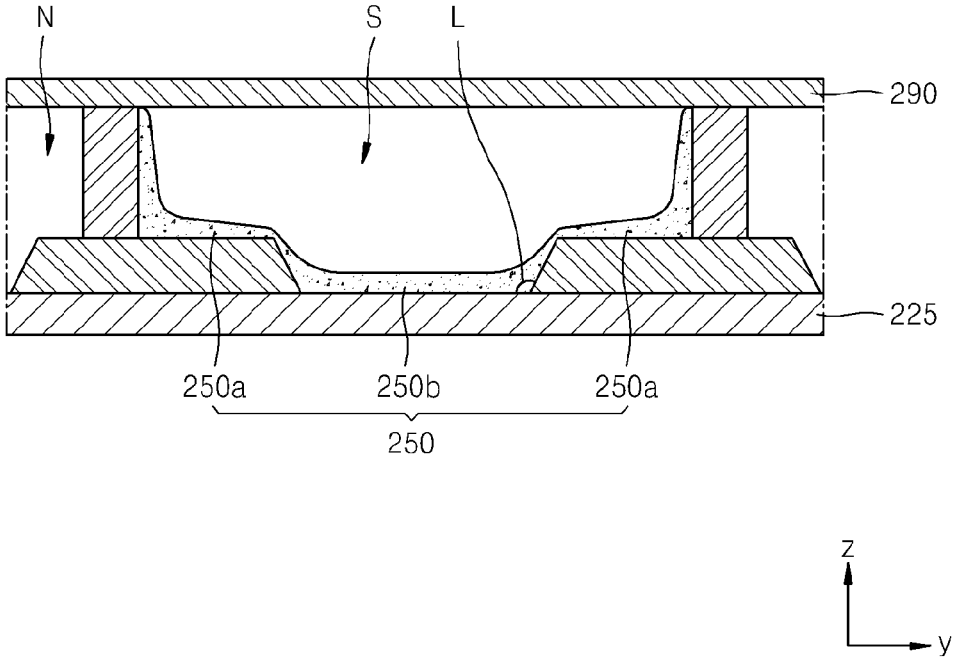
FIG. 8 is a cross-sectional view of a discharge cell of the plasma display panel of FIG. 7.
Figure 9:
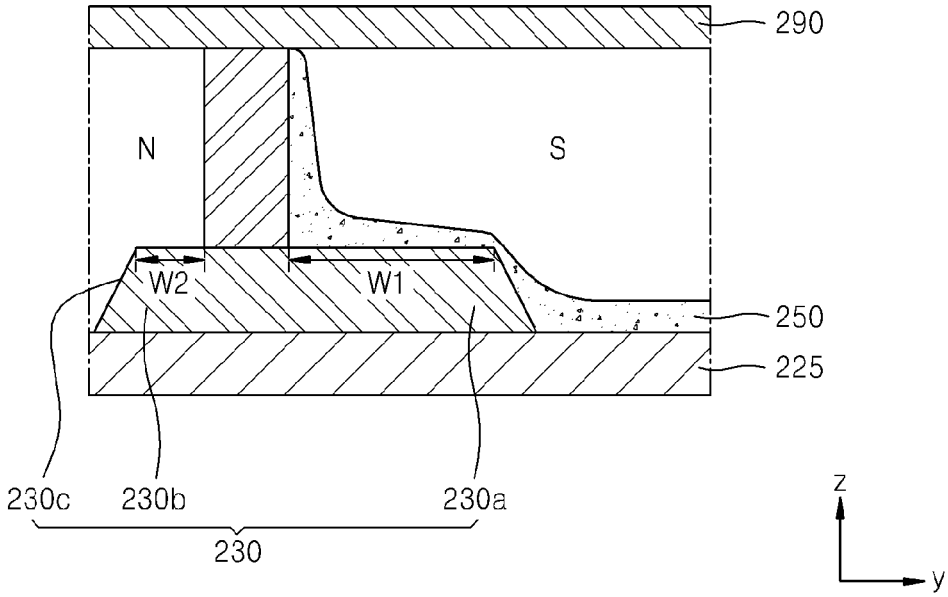
FIG. 9 is a cross-sectional view of a first member and a double second member included in the plasma display panel illustrated in FIG. 7.

FIGS. 6 through 9 illustrate a plasma display panel according to another embodiment of the present invention. FIG. 6 is a partial perspective view of a plasma display panel according to another embodiment, FIG. 7 is a cross-sectional view of the plasma display panel of FIG. 6, and FIG. 8 is a cross-sectional view of a discharge cell of the plasma display panel of FIG. 6. FIG. 9 is a cross-sectional view of a first member and a second member of the plasma display panel of FIG. 6.

Hereinafter, the plasma display panel including first members and double second members will be described.

Referring to FIG. 6, a lower panel of the plasma display panel includes a first substrate 210, a plurality of address electrodes 220 arranged parallel in a Y direction on the first substrate 210, the first dielectric layer 225 formed on the first substrate 210 to cover the address electrodes 220, a first member 230 formed on the first dielectric layer 225, a second member 240 that partitions a discharge space into a plurality of discharge cells, and a phosphor layer 250 coated in the discharge cells.

In one embodiment, the second member 240 includes a single second member 240*y* extended in a Y direction and a double second member 240*x* extended in an X direction. A plurality of phosphor layers 250 emitting light having different colors may be arranged in the discharge cells S partitioned by the single second member 240*y*. Also, a plurality of phosphor layers 250 emitting light having the same color may be arranged in the discharge cells S partitioned by the double second member 240*x*.

Also, an upper panel of the plasma display panel includes a plurality of second substrates 260, sustaining discharge electrode pairs 270 extended in an X direction, the second dielectric layer 280 formed on the second substrate 260 to cover the sustaining discharge electrode pairs 270, and a protection layer 290 formed on the second dielectric layer 280. The sustaining discharge electrode pairs 270 each include a sustaining electrode X and a scanning electrode Y, and the sustaining electrode X includes a sustaining transparent electrode 271X and a sustaining bus electrode 273X, and the scanning electrode Y includes a scanning transparent electrode 271Y and a scanning bus electrode 273Y.

The structure of the second member 240 will be described in detail with reference to FIG. 7, which is a cross-sectional view of the plasma display panel of FIG. 6 cut along the Y direction, and FIGS. 8 and 9, which illustrate the discharge cell S in extension.

Referring to FIG. 7, the double second member 240*x* has a structure in which a horizontal second (or row) member 240*xa* and another horizontal adjacent second member 240*xb* form a discharge cell S, and the horizontal second member 240*xa* and another horizontal second member 240*xb* adjacent to the horizontal second member 240*xa* form a non-discharge cell N that functions as a discharge path.

Referring to FIG. 8, the phosphor layer 250 is coated on upper and lateral surfaces of the first member 230. The phosphor layer 250 may be classified into a first area 250*a* that is formed on upper and lateral surfaces of the first member 230 and a second area 250*b* that is formed on an upper surface of the first dielectric layer 225.

Referring to FIG. 9, lateral surfaces of the first member 230 are formed as inclined surfaces 230*c*, and the first member 230 may be classified into a first area 230*a* protruding into the discharge cell S and a second area 230*b* protruding into the non-discharge cell N. A protrusion width W1 of the first area 230*a* protruding into the discharge cell S may be greater than a protrusion width W2 of the second area 230*b* protruding into the non-discharge cell N. In this embodiment, a discharge path of the phosphor layer 250 formed on the first area 230*a* protruding into the discharge cell S is relatively short and thus greatly increases luminance.

Figure 10:
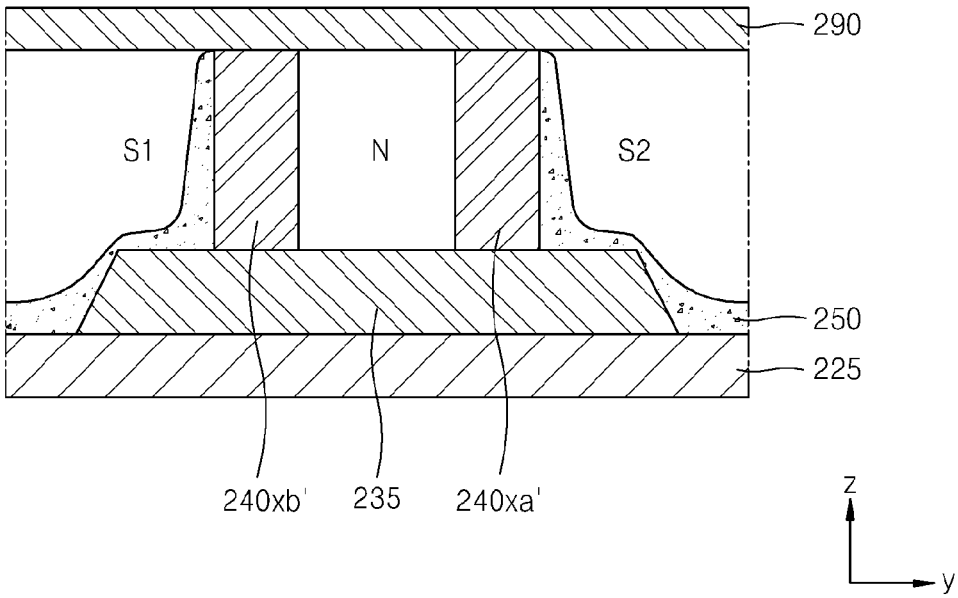
FIG. 10 is a cross-sectional view of a first member and a double second member included in a plasma display panel according to another embodiment of the present invention.

According to another embodiment, the plasma display panel may include a second member as illustrated in FIG. 10.

Referring to FIG. 10, first and second horizontal second members 240*xa*' and 240*xb*' are formed adjacent to each other on a single first member 235. In one embodiment, the first horizontal second member 240*xb*' and the second horizontal second member 240*xa*' are formed on the first member 235, and a non-discharge cell N formed between the first and second horizontal second members 240*xb*' and 240*xa*' may be used as a discharge path. Also, the first horizontal second member 240*xb*' may form a sidewall of a first discharge cell S1, and the second horizontal second member 240*xa*' may form a sidewall of a second discharge cell S2.

Hereinafter, a method of manufacturing a plasma display panel according to an embodiment of the present invention will be described with reference to FIGS. 11 through 17.

Figure 11:
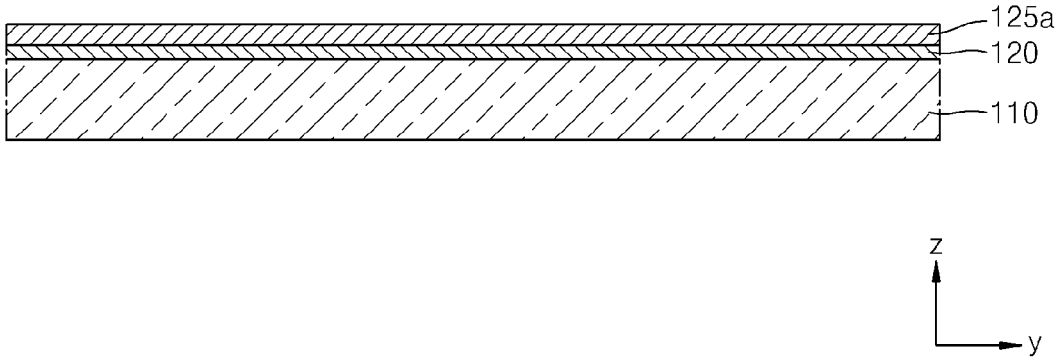
FIGS. 11 through 17 are cross-sectional views illustrating a method of manufacturing a plasma display panel, according to an embodiment of the present invention.

First, referring to FIG. 11, a plurality of address electrodes 120 extending in a Y direction are formed on a first substrate 110. Then a first paste 125*a* for forming the first dielectric layer is coated on the address electrodes 120 and dried.

Figure 12:
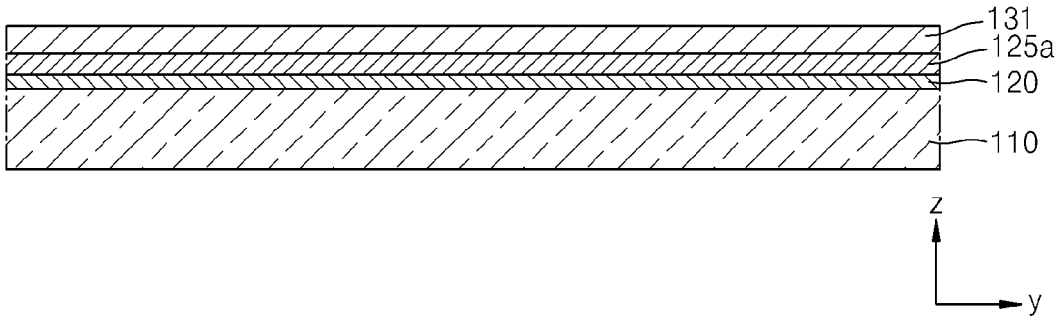
Figure 13:
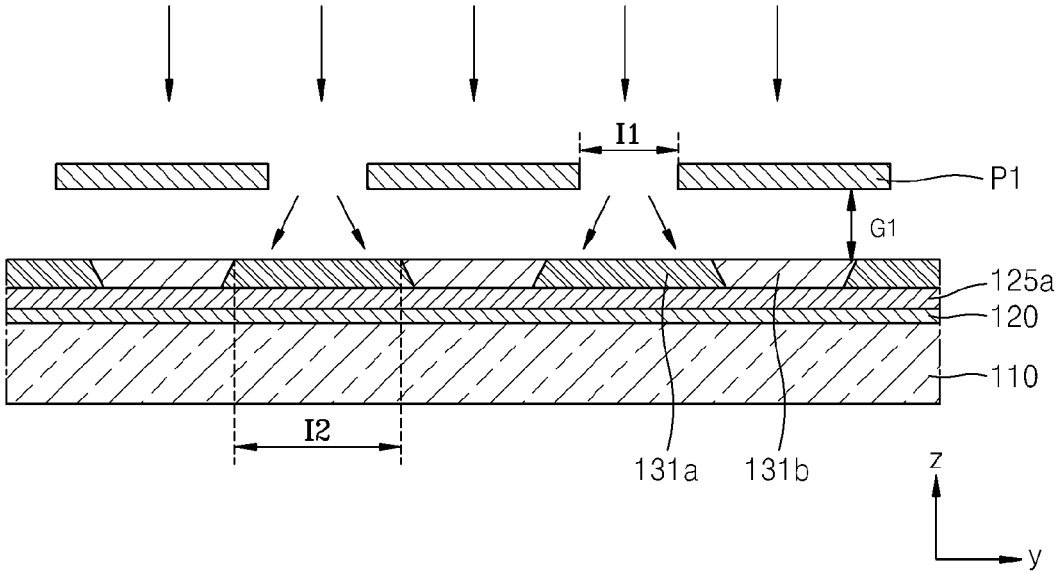

Referring to FIG. 12, a second paste 131 for forming a first member is coated and dried on the first paste 125*a*. The second paste 131 includes a photosensitive organic material such as glass frit for performing patterning using a photolithography process. Examples of the photosensitive organic material include a photoinitiator, a binder, and a cross-linking agent.

The photoinitiator may be any compound that generates a radical during the photolithography process and generates initiates a cross linking reaction of the cross-linking agent. Examples of the photoinitiator include benzophenone, o-benzoil benzoic acid methyl, 4,4-bis(dimethylamine)benzophenone, 4,4-bis(diethylamino)benzophenone, 2,2-diethoxyacetophenone, 2,2-dimethoxy-2-phenyl-2-phenyl acetophenone, 2-methyl-[4-(methylthio)phenyl]-2-morpolynopropane-1-on, 2-benzyl-2-dimethylamino-1-(4-morpolynophenyl)-1-butanone, bis(2,6-dimethoxybenzoil)-2,4,4-trimethylpentyl phosphine oxide, bis(2,4,6-trimethylbenzoil)phenyl phosphine oxide, and a mixture of at least two of these.

The cross-linking agent may be any compound that can radically polymerize using the photoinitiator. Examples of the cross-linking agent include monofunctional and polyfunctional monomers; in detail, a polyfunctional monomer may be used to increase exposure sensitivity. Examples of the polyfunctional monomers include the following: diacrylates such as ethylene glycol diacrylate (EGDA); triacrylates such as trimethylol propane triacrylate (TMPTA), trimethylol propane ethoxylate triacrylate (TMPEOTA), and penta erisritol triacrylate; tetraacrylates such as tetramethylol propane tetraacrylate and pentaerisritol tetraacrylate; hexaacrylates such as dipentaerisritol hexaacrylate (DPHA); and a composition formed of at least two of these.

The binder may be a polymer that can be cross-linked using the photoinitiator and easily removed using a development process. Examples of the binder include acrylic resin, styrene resin, Novolac resin, polyesther resin, and a combination of at least two of these. Examples of the binder include carboxylic group-containing monomers, hydroxyl group-containing monomers, and copolymerizable monomers. Examples of the carboxylic group-containing monomers include acrylic acid, methacrylic acid, fumaric acid, crotonic acid, itaconic acid, citraconic acid, mesaconic acid, cinnomic acid, succinic acid mono(2-(meth)acryloiloxy ethyl), and ω-carmoxy-polycaprolactonemono(meth)acrylate. Examples of the hydroxyl group-containing monomers include the following: hydroxyl group-containing monomers such as (meth)acrylic acid2-hydroxyethyl, (meth)acrylic acid2-hydroxy propyl, and (meth) acrylic acid3-hydroxy propyl; and phenolic hydroxyl group-containing monomers such as o-hydroxystyrene, m-hydroxystyrene, and p-hydroxystyrene. Examples of the copolymerizable monomers include the following: (meth) acrylic acid esters such as (meth)acrylic acid methyl, (meth) acrylic acid ethyl, (meth)acrylic acid n-butyl, (meth)acrylic acid n-lauril, (meth)acrylic acid benzyl, glycidyl(meth)acrylate, and dicycloro pentanyl(meth)acrylate; aromatic vinyl monomers such as styrene and α-methylstyrene; conjugated dienes such as butadien and isoprene; and macro monomers having a polymerization unsaturated group like a (meth)acryloyl group at a terminal of a polymer chain, such as polystyrene, poly(meth)acrylic acid methyl, poly(meth)acrylic acid ethyl, and poly(meth)acrylic acid benzyl.

After coating and drying the second paste 131, an exposure process is performed using a first exposure mask P1. In one embodiment, the first exposure mask P1 has a line width l1. The line width l1 of the first exposure mask P1 may be about 30-70% of the width of the first member. The line width l1 may be determined based on an upper width l2 of the first member. Also, the first exposure mask P1 may be arranged from the second paste 131 a distance G1 of about 600 μm to about 2 mm to expose the second paste 131. Accordingly, diffusion of exposure light may be induced so that the first member has inclined surfaces.

After performing the exposure process with respect to the second paste 131 for forming the first member, the second paste 131 is divided into an exposed portion 131*a* and an unexposed portion 131*b*. The exposed portion 131*a* may be polymerized by being exposed to light and hardened. This is an example of positive exposure. In addition, a negative exposure, in which an exposed area is decomposed and developed using different types of photosensitive materials, is also possible.

Figure 14:
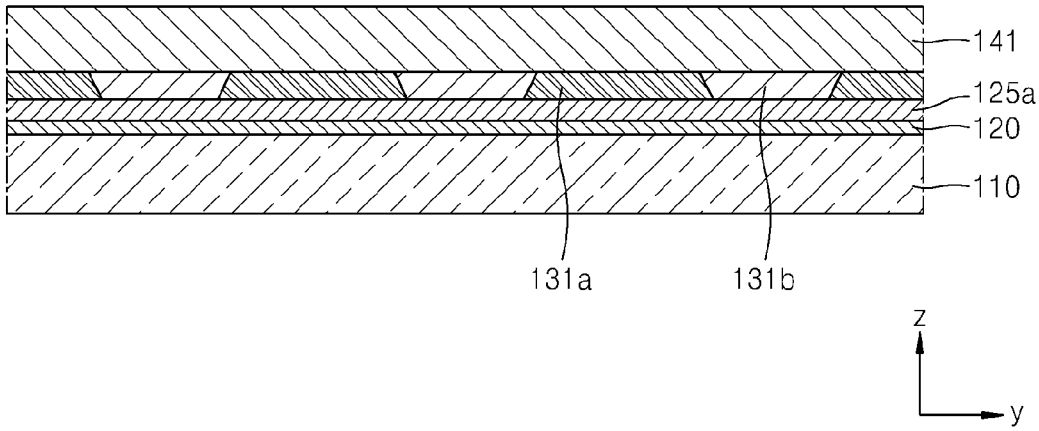

After the exposure as described above, a third paste 141 for forming a second member is coated as illustrated in FIG. 14. The second member is also formed using a photolithography process, and thus the third paste 141 may include the above-described photosensitive organic material. Then the third paste 141 is dried.

Figure 15:
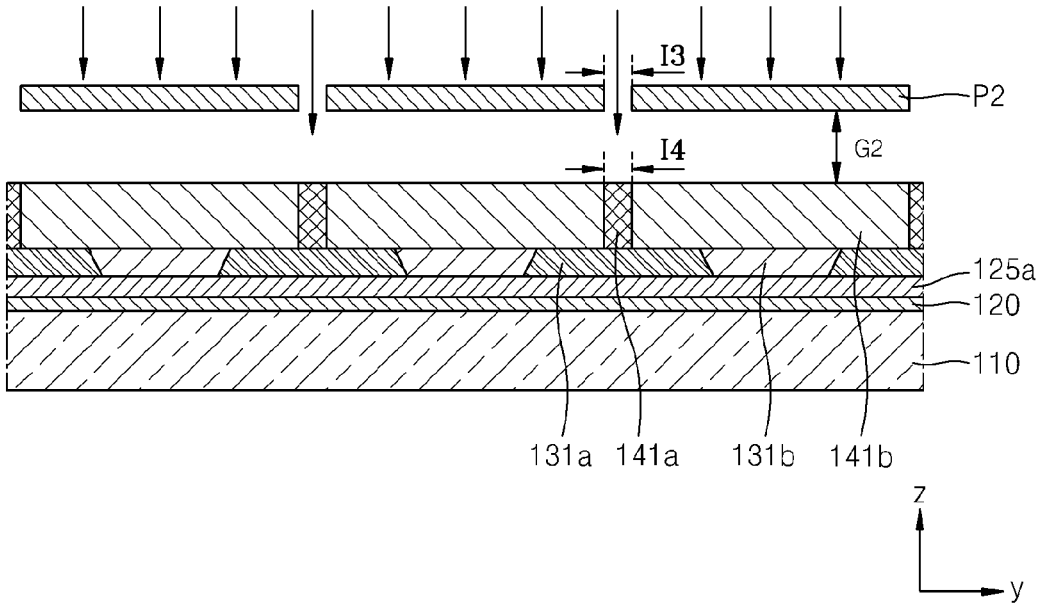
Figure 16:
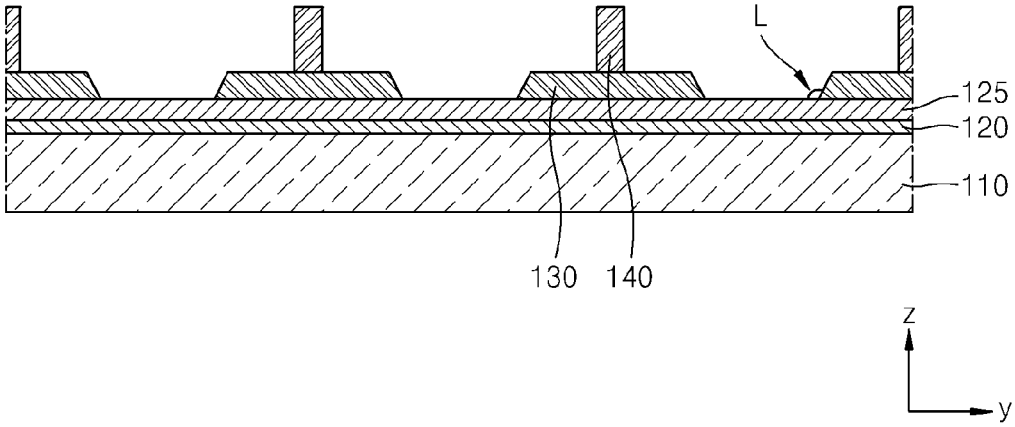
Figure 17:
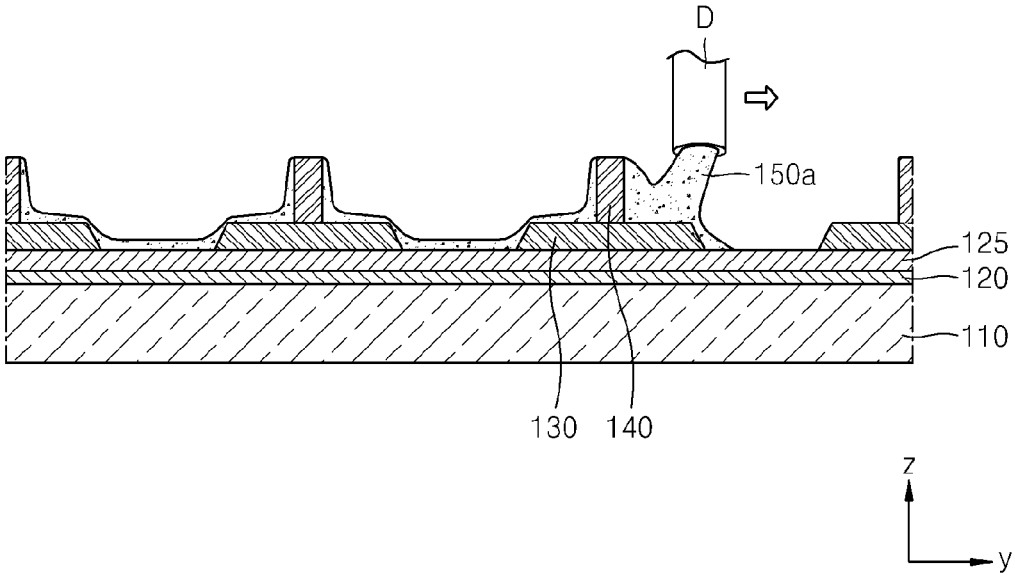

Referring to FIG. 15, a second exposure mask P2 is disposed above the third paste 141 and a second exposure is performed. The second exposure mask P2 has a line width l3, which may be about 80% to about 120% of an upper line width l4 of the second member. Also, the second exposure mask P2 may be disposed from the third paste 141 in a distance G2. The distance G2 may be about 400 μm to about 1 mm. After the second exposure, the third paste 141 is classified into an exposed portion 141*a* and an unexposed portion 141*b*.

By using a developing solution, the second paste 131 and the third paste 141 may be developed at the same time. The first dielectric layer 125, the first member 130, and the second member 140 may be formed by firing at the same time after the development. Unlike the second member 140, a line width of the exposure mask for the first member 130 is set to be smaller than a width of the first member 130 to be formed and the exposure mask for the first member 130 is disposed higher so that the first member 130 has inclined surfaces at a predetermined angle L. In other words, lateral surfaces of the first member 130 are formed as inclined surfaces.

After forming the second member 140, a nozzle D is moved at a predetermined speed to eject a fourth paste 150*a* for forming a phosphor layer, thereby coating the fourth paste 150*a* uniformly on the first member 130 and symmetrically in the discharge cells. Then the fourth paste 150*a* is dried and/or fired to form a phosphor layer.

Although not illustrated in the drawings, the upper panel and the lower panel, on which the phosphor layer is formed, of the plasma display panel may be adhered to each other to complete the plasma display panel.

At least a surface of the first member is formed as an inclined surface, and thus a phosphor layer is uniformly coated substantially.

Also, a lateral surface of the first member is formed as an inclined surface, and thus a path of light emitted from the phosphor layer formed on the inclined surface is short compared to that of a vertical lateral surface of the first member. Accordingly, luminance can be increased.

Also, since the lateral surface of the first member is formed as an inclined surface, the surface area of the first dielectric layer contacting the first member is increased, thereby preventing cracks which are caused due to a difference in heat expansion coefficients between the second member and the first dielectric layer during a firing process.

In addition, the first and second members may be exposed by adjusting line widths and/or intervals of photomasks and then be developed at the same time. Accordingly, the first and second members can be easily manufactured.

In addition, by firing the first member, the second member, and the first dielectric layer at the same time, productivity can be increased.

While an aspect of the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a first substrate and a second substrate facing the first substrate;

a first dielectric layer formed on the first substrate;

a first member formed on the first dielectric layer and comprising at least one inclined surface;

a second member disposed between the first member and the second substrate and partitioning a discharge space between the first member and the second substrate into a plurality of discharge cells, wherein the second member comprises a surface for each discharge cell which is substantially perpendicular to the first substrate;

a plurality of electrodes arranged across the plurality of the discharge cells;

a phosphor layer disposed on the first member and at least part of the second member; and discharge gas filled in the discharge cells, wherein the electrodes comprise a discharge electrode pair comprising a scanning electrode and a sustaining electrode, and an address electrode that is arranged to cross the scanning electrode, and wherein the discharge electrode pair is disposed on the second substrate, wherein the address electrode is disposed on the first substrate.

2. The plasma display panel of claim 1, wherein the inclined surface is at an angle of about 100° to about 170° with respect to the first substrate.

3. The plasma display panel of claim 1, wherein a lateral surface of the first member is inclined.

4. The plasma display panel of claim 1, wherein the first member comprises a photosensitive material.

5. The plasma display panel of claim 1, wherein a lower surface of the first member is larger than an upper surface of the first member.

6. The plasma display panel of claim 1, wherein a surface area of the first member contacting the first dielectric layer is greater than a surface area of the first member contacting the second member.

7. The plasma display panel of claim 1, wherein a discharge area in the discharge cells is divided into i) a main discharge area comprising a phosphor layer that is formed on an upper surface and the inclined surface of the first member and ii) an auxiliary discharge area comprising other areas of the phosphor layer disposed in the discharge cell, over which the first member is not formed, and wherein the discharge electrode pair is arranged across the main discharge area.

8. The plasma display panel of claim 1, wherein the plasma display panel further comprises i) the second dielectric layer formed below the second substrate to cover the discharge electrode pair and ii) a first dielectric layer formed on the first substrate to cover the address electrode.

9. The plasma display panel of claim 8, further comprising a protection layer formed on the second dielectric layer, wherein the protection layer contacts the second member.

10. The plasma display panel of claim 1, wherein the second member comprises a plurality of row members and a plurality of column members, and wherein the row members and the column members cross each other.

11. The plasma display panel of claim 10, wherein one of the row members forms a non-discharge cell with an adjacent row member, and wherein the one row member forms a discharge cell with another adjacent row member.

12. The plasma display panel of claim 11, wherein the first member protrudes both into the non-discharge cell and into the discharge cell.

13. The plasma display panel of claim 12, wherein the first member comprises i) a first portion that protrudes into the non-discharge cell, and ii) a second portion that protrudes into the discharge cell, and wherein the second portion is broader than the first portion.

14. The plasma display panel of claim 11, wherein the first member comprises a plurality of sub-first members which are substantially parallel with each other, and wherein the one row member and the adjacent row member forming the non-discharge cell are formed on the same sub-first member.

15. The plasma display panel of claim 11, wherein the first member comprises a plurality of sub-first members which are substantially parallel with each other, wherein the one row member and the adjacent row member forming the non-discharge cell are formed on two different sub-first members, respectively.

16. The plasma display panel of claim 1, wherein a surface area of the first member, which has the inclined surface, contacting the phosphor layer is larger than a surface area of a first member that has no inclined surface contacting the phosphor layer.

17. The plasma display panel of claim 1, wherein a path of light emitted from a portion of the phosphor layer formed over the inclined surface of the first member is shorter than a path of light emitted from a portion of the phosphor layer formed over a vertical surface of a first member.

18. A plasma display panel comprising:

a first substrate and a second substrate facing the first substrate;

a first dielectric layer formed on the first substrate;

a first member formed on the first dielectric layer, wherein the first member comprises a plurality of sub-first members which are substantially parallel with each other, wherein each of the sub-first members comprises at least one inclined surface which is inclined with respect to at least one of the first and second substrates, and wherein the first member is substantially parallel with at least one of the first and second substrates;

a second member contacting the first member, wherein the second member comprises a plurality of row members and a plurality of column members which cross each other so as to define a plurality of discharge cells between the first member and the second substrate, and wherein the second member is substantially perpendicular to the first member, and wherein the second member comprises a surface for each discharge cell which is substantially perpendicular to the first substrate;

a plurality of electrodes arranged across the plurality of discharge cells; and a phosphor layer formed on the first member and at least part of the second member, wherein the electrodes comprise a discharge electrode pair comprising a scanning electrode and a sustaining electrode, and an address electrode that is arranged to cross the scanning electrode, and wherein the discharge electrode pair is disposed on the second substrate, wherein the address electrode is disposed on the first substrate.

19. A plasma display panel, comprising:

a first substrate and a second substrate facing the first substrate;

a first member formed over the first substrate and comprising at least one inclined surface;

a second member disposed between the first member and the second substrate and partitioning a discharge space between the first member and the second substrate into a plurality of discharge cells;

a plurality of electrodes arranged across the plurality of the discharge cells;

a phosphor layer disposed on the first member and at least part of the second member; and discharge gas filled in the discharge cells, wherein the electrodes comprise a discharge electrode pair comprising a scanning electrode and a sustaining electrode, and an address electrode that is arranged to cross the scanning electrode, and wherein the discharge electrode pair is disposed on the second substrate, wherein the address electrode is disposed on the first substrate, wherein the second member comprises a plurality of row members and a plurality of column members, and wherein the row members and the column members cross each other Wherein one of the row members forms a non-discharge cell with an adjacent row member, and wherein the one row member forms a discharge cell with another adjacent row member, wherein the first member protrudes both into the non-discharge cell and into the discharge cell, and wherein the first member comprises i) a first portion that protrudes into the non-discharge cell, and ii) a second portion that protrudes into the discharge cell, and wherein the second portion is broader than the first portion.

* * * * *